US012203725B2

(12) United States Patent
Boomgaarden et al.

(10) Patent No.: US 12,203,725 B2
(45) Date of Patent: Jan. 21, 2025

(54) BARREL NUT HANDGUARD ATTACHMENT

(71) Applicant: Breek LLC, Beaver Creek, MN (US)

(72) Inventors: Joshua Boomgaarden, Beaver Creek, MA (US); Evan Meinerts, Luverne, MN (US)

(73) Assignee: Breek LLC, Beaver Creek, MN (US)

( * ) Notice: Subject to any disclaimer, the term of this patent is extended or adjusted under 35 U.S.C. 154(b) by 0 days.

(21) Appl. No.: 18/216,912

(22) Filed: Jun. 30, 2023

(65) Prior Publication Data

US 2024/0003654 A1 Jan. 4, 2024

Related U.S. Application Data

(60) Provisional application No. 63/357,829, filed on Jul. 1, 2022.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 8,904,691 | B1 * | 12/2014 | Kincel | F41C 23/16 42/71.01 |
| 9,335,117 | B2 | 5/2016 | Miller et al. | |
| 9,389,043 | B1 * | 7/2016 | Zhang | F41C 23/16 |
| 9,464,865 | B2 | 10/2016 | Shea et al. | |
| 10,126,095 | B1 | 11/2018 | Reid | |
| 2011/0247254 | A1 * | 10/2011 | Barnes | F41A 21/48 42/75.01 |
| 2015/0316347 | A1 | 11/2015 | Shea et al. | |
| 2017/0299326 | A1 * | 10/2017 | Seekins | F41A 21/482 |
| 2018/0202757 | A1 * | 7/2018 | Samson | F41A 21/48 |
| 2018/0306551 | A1 * | 10/2018 | Reid | F41A 21/485 |
| 2019/0170476 | A1 * | 6/2019 | Hiler, Jr. | F41A 21/482 |
| 2023/0129047 | A1 * | 4/2023 | Miller | F41C 23/16 42/75.01 |

FOREIGN PATENT DOCUMENTS

| | | | | |
|---|---|---|---|---|
| CA | 2877197 | A1 * | 7/2015 | F41C 23/16 |
| EP | 2894431 | A1 * | 7/2015 | F41C 23/16 |

* cited by examiner

*Primary Examiner* — Jonathan C Weber
(74) *Attorney, Agent, or Firm* — Wood Herron & Evans, LLP

(57) ABSTRACT

A firearm handguard attachment device comprises a barrel nut having a forward end, a rearward end, and a circumferential recess between the forward end and the rearward end, the recess having an uninterrupted surface and defining a forward shoulder and a rearward shoulder, a handguard having a forward end and a rearward end and configured to be slid onto the barrel nut, the handguard having a transversely extending opening in a lower portion thereof, the opening having a seat at each opposite end, a pair of wedges, one wedge of the pair being installed in one of the seats and the other wedge of the pair being installed in the other seat, and at least one fastener for drawing the wedges toward one another. The wedges are configured to engage the uninterrupted surface of the recess to prevent axial translation of the handguard relative to the barrel nut and to prevent axial rotation of the handguard relative to the barrel nut.

2 Claims, 6 Drawing Sheets

BARREL NUT HANDGUARD ATTACHMENT

RELATED APPLICATION

This application claims the priority benefit of U.S. Provisional Patent Application No. 63/357,829, filed Jul. 1, 2022, the entirety of which is incorporated by reference herein.

TECHNICAL FIELD

This invention relates to a handguard which can be used on an AR-patterned firearm upper receiver.

BACKGROUND

In the field of firearms, particularly firearms with elongate barrels such as rifles and shotguns, handguards are a common accessory. Handguards—also commonly referred to as fore-end guards, forearm guards, and foregrips—are mainly used to stabilize the firearm in the user's grasp and prevent burns or other injury to the user when correctly gripping the firearm.

Handguards are typically constructed out of polymer resins or aluminum. Handguards are hollow, generally tubular sheaths which fit around the firearm barrel. Handguards can be multiple pieces (i.e., a drop-in handguard) in which two (or more) component pieces are detachably secured to one another around the firearm barrel and mounted in place at both a forward and a rearward section of the barrel. Handguards can also be "free floating" in which the handguard is a singular piece which slides around the barrel and is mounted by a barrel nut at a rearward section of the barrel.

There are various challenges in mounting a handguard and traditional mounting techniques which are associated with known handguards in the art address these challenges in various ways.

Free-floating handguards are mounted by fixing the rearmost portion of the handguard to a barrel nut, adjacent and/or proximate to the upper receiver. Unlike drop-in handguards, free-floating handguards do not require contact between the handguard and a forward portion of the barrel. This prevents forces which are applied to the handguard from being transmitted to the barrel—thus eliminating barrel deflection (the result of the transmission of those forces) and increasing accuracy. However, as previously described, free-floating handguards still require a point of attachment adjacent the rearward portion of the barrel in order to securely mount the handguard.

There are two primary types of barrel nuts that can be used for mounting free-floating handguards: "timed" or "clocked" barrel nuts and slip-style barrel nuts. U.S. Pat. No. 9,909,836 shows a free-floating rifle handguard which is attached to a firearm upper receiver via timed barrel nut. Timed barrel nuts require precise rotational alignment for proper installation. Free-floating handguards in the art which are mounted on the firearm via slip-style barrel nut face the challenges of preventing rotational and longitudinal displacement. Some free-floating handguards in the art include a longitudinal slot, allowing it to be clamped to the barrel nut in a way that causes deformation when the securement screws are tightened together. Such a mounting technique causes the handguard to be clamped together which pulls the sidewalls out of their factory configuration. This can result in deformities to the mounting rails. Other systems uses clamping wedges, but must address the longitudinal displacement challenge with additional structure. See, for example, U.S. Pat. Nos. 10,126,095 and 9,464,865.

Accordingly, there remains room for improvement in firearm handguards.

SUMMARY OF THE INVENTION

In one aspect, a firearm handguard attachment device comprises a barrel nut having a forward end, a rearward end, and a circumferential recess between the forward end and the rearward end, the recess having an uninterrupted surface and defining a forward shoulder and a rearward shoulder, a handguard having a forward end and a rearward end and configured to be slid onto the barrel nut, the handguard having a transversely extending opening in a lower portion thereof, the opening having a seat at each opposite end, a pair of wedges, one wedge of the pair being installed in one of the seats and the other wedge of the pair being installed in the other seat, and at least one fastener for drawing the wedges toward one another. The wedges are configured to engage the uninterrupted surface of the recess to prevent axial translation of the handguard relative to the barrel nut and to prevent axial rotation of the handguard relative to the barrel nut.

Each wedge can have a laterally inwardly facing arcuate surface and an upwardly facing surface having a length in a longitudinal direction. A radius of curvature of the arcuate surface can match a radius of curvature of the uninterrupted surface of the recess. The length of the upper surface can match a length between the forward and rearward shoulders of the recess.

The barrel nut can include knurling on the rearward end and wrench flats on the forward end.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
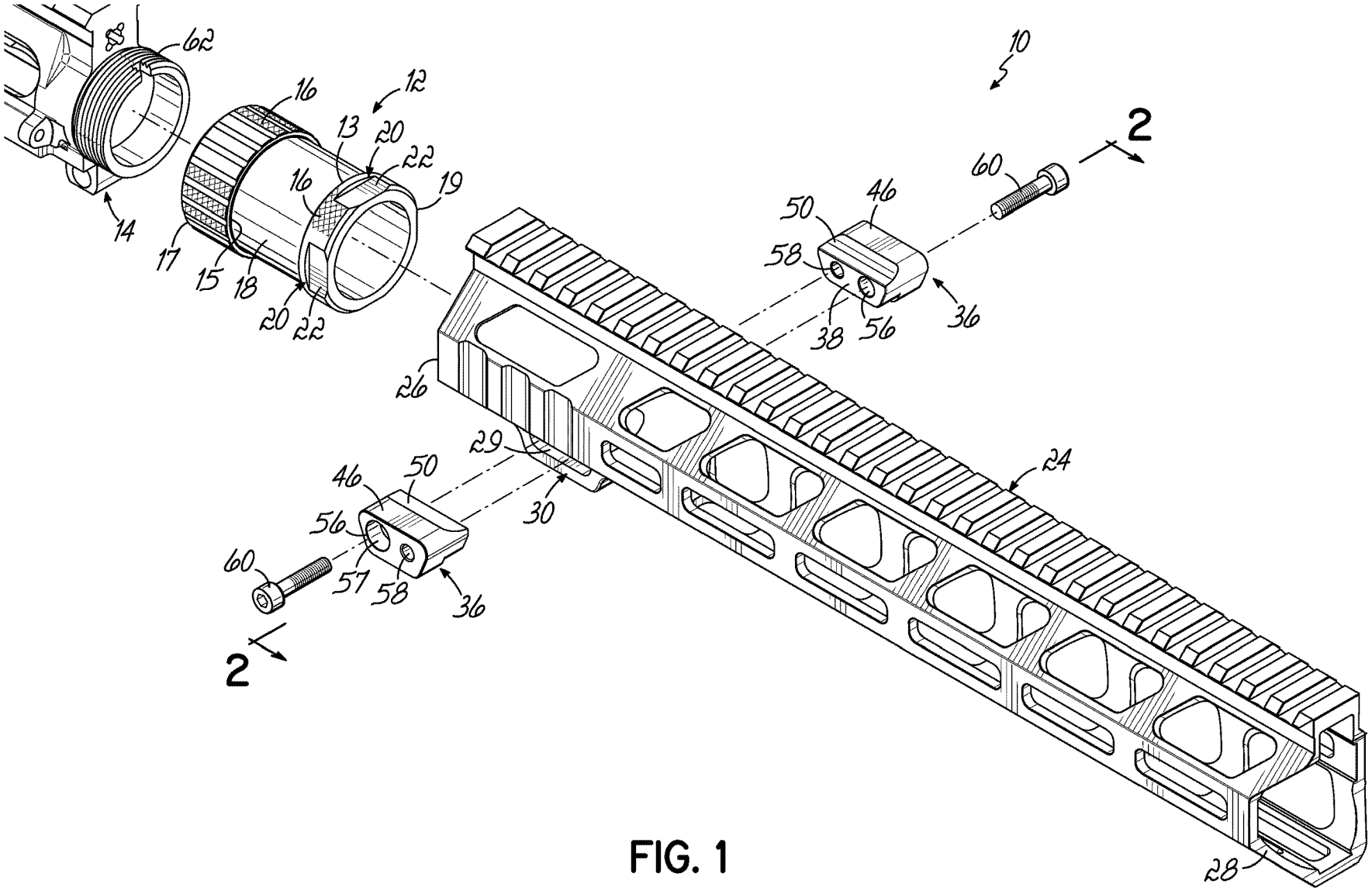
FIG. 1 is a disassembled isometric view of a handguard attachment according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. When referring to a firearm, "forward" will indicate the direction of the muzzle and the direction in which projectiles are fired, while "rearward" will indicate the opposite direction. "Lateral" or "transverse" indicates a side-to-side direction generally perpendicular to the axis of the barrel or to the longitudinal extension of the referenced part. Although firearms may be used in any orientation, "left" and "right" will generally indicate the sides according to the user's orientation, "top" or "up" will be the upward direction when the firearm is gripped, or the apparatus used in the ordinary manner.

Referring first to FIG. 1, therein is shown a handguard attachment 10 according to one embodiment of the present invention. As used herein, the handguard attachment 10 generally comprises a barrel nut 12 which is configured to be threadingly fastened to an upper receiver 14. The barrel nut 12 is capable of slidingly receiving a handguard 24. The barrel nut 12 possesses an outer surface 16, the outer surface 16 having a smooth, uninterrupted circumferential recess 18 which extends around the circumference of the barrel nut 12 and defines a forward shoulder 13 and a rearward shoulder 15. The rearward portion 17 of the outer surface 16 of the barrel nut 12 may be knurled. The knurling may be produced by ridges which are parallel or crossing each other perpendicularly or at a non-right angle. Other types of knurling (e.g., straight, diamond) may be used but are not shown. The forward portion 19 of the barrel nut 12 may have a plurality of flats 20 spaced circumferentially around the barrel nut 12. Each flat 20 may define a smooth flat surface 22. The knurling provides an easily gripped friction surface to hand tighten the barrel nut 12 onto the receiver 14. A person having skill in the art will also appreciate that knurling of surfaces such as the rearward portion 17 of the outer surface 16 causes greater friction between the static barrel nut 12 and the handguard 24, thus preventing rotational misalignment of the handguard 24 around the circumference of the barrel nut 12. The flats 20, spaced 90 degrees from one another, function as wrench flats wherein opposite ones of the surfaces 22 and are engageable with a wrench to torque the barrel nut to spec.

Referring still to FIG. 1, the handguard 24 which is shown possesses a first end 26 and a second end 28. The handguard 24 is generally hollow between the first end 26 and the second end 28. Once the barrel nut 12 is torqued to spec, handguard 24 is slid over the outer surface 16 of the barrel nut 12 such that the rearmost portion of the handguard 24 is at least partially superimposed with the rearward portion 17 of the barrel nut 12.

Figure 2:
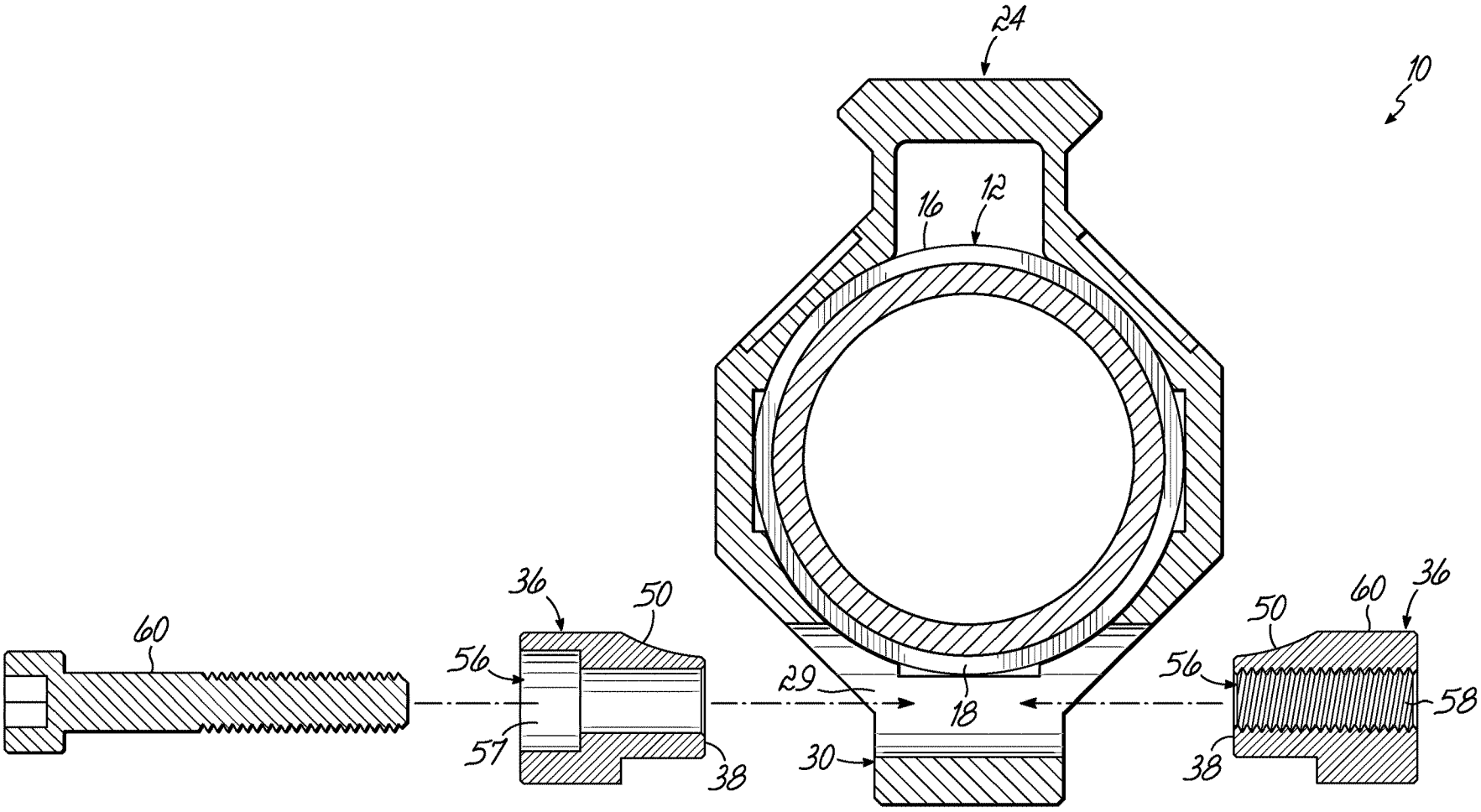
FIG. 2 is a disassembled cross-sectional exploded view of a handguard attachment taken along line 2-2 of FIG. 1.

Referring to FIG. 2, an opening 29 extends transversely through a bottom portion of the handguard 24. A seat 30 is located at each opposite end of the opening 29. The seat 30 has a longer dimension and a shorter dimension, with the longer dimension being oriented along the longitudinal axis of the handguard 24. As shown in FIG. 1, the seat 30 is externally accessible but other embodiments (not shown) may feature a seat which is enclosed and only accessible when the handguard 24 is uninstalled on a firearm. Each seat 30 is configured to accept one of a pair of wedges 36. Each wedge 36 has an interior side 38 which may be inserted into the seat 30. When inserted into the seat 30, the wedges 36 are capable of interlocking with one another so as to forcibly engage the circumferential recess 18 of the barrel nut 12, as will be subsequently described. The embodiment shown and described in FIG. 1 depicts the overall shape of the wedges 36 as generally trapezoidal, when viewed from the side. However, other shapes may be used. The interior side 38 of each wedge includes an arcuate upper surface or face 50. When installed, the arcuate surfaces 50 engage the circumferential recess 18 of the barrel nut. Preferably, the radius of curvature of the arcuate surfaces 50 matches the radius of curvature of the circumferential recess 18.

Each of a pair of bores 56 extends through each wedge 36 such that each of the bores 56 is perpendicular to the longitudinal axis of the handguard 24 when the wedges 36 are inserted into the seats 30. The bores 56 of each wedge 36 are located such that when the wedges 36 are inserted into their respective seats 30, the bores 56 of one wedge 36 align with the bores 56 of the other wedge. The embodiment shown in FIG. 1 depicts the wedges 36 as possessing two bores 56. However, in other embodiments (not shown), more than two bores may be used.

Figure 3:
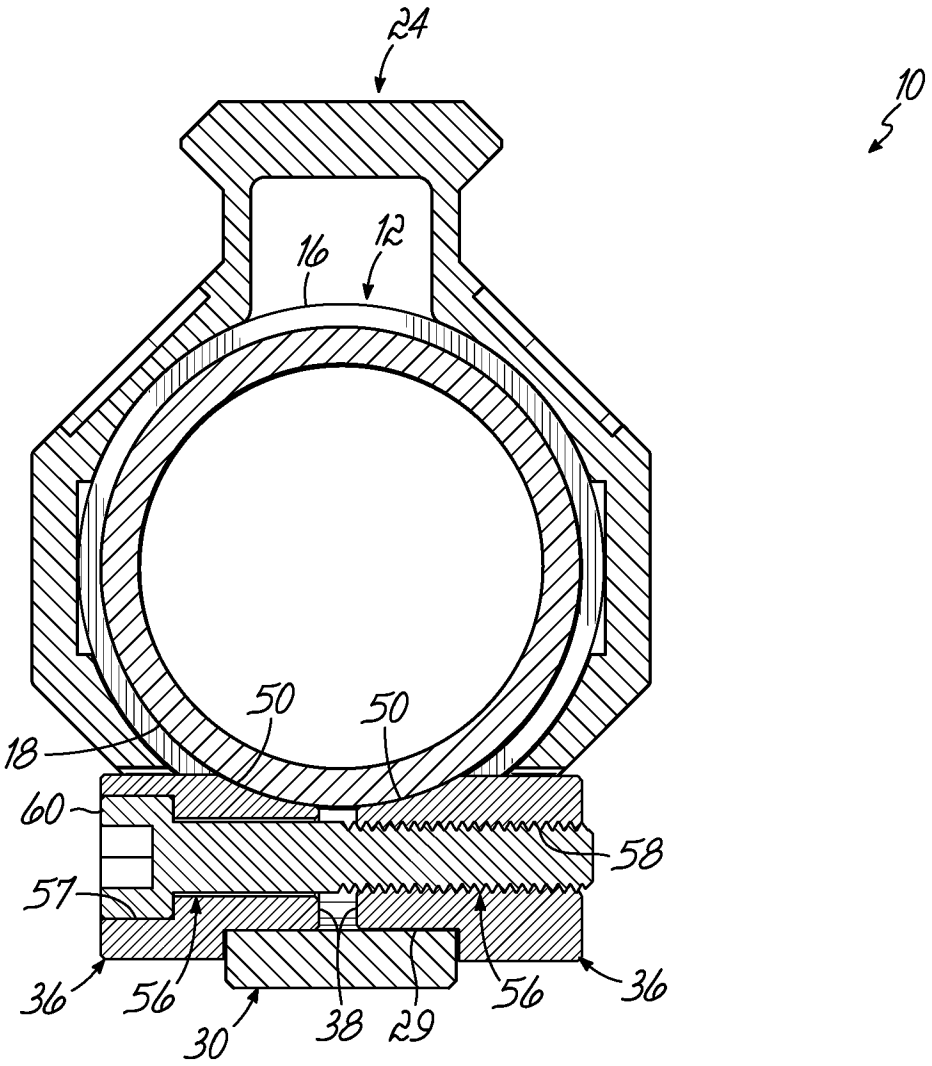
FIG. 3 is a cross-sectional view similar to FIG. 2 but showing the handguard attachment assembled.

Referring now to FIGS. 2 and 3, one bore 56 of each wedge 36 is a clearance bore 57 and the other bore 56 of each wedge 36 is a threaded bore 58. First and second fasteners 60 are inserted from opposite sides through their respective clearance bores 57 and are threaded into their respective threaded bores 58. When the fasteners 60 are tightened, the fasteners 60 urge the wedges 36 towards one another, and in doing so urge the arcuate face 50 of each wedge 36 into abutment with the circumferential recess 18 to secure the handguard 24 to the barrel nut 12. A person having ordinary skill will also appreciate that such tightening causes downwards forces to be transmitted from the wedges 36 to the seat 30, rather than compressing the handguard 24 out of factory configuration. The handguard 24 may be secured to the barrel nut 12 by only a single pair of the wedges 36. Rotational misalignment is prevented by the force exerted by surfaces 50 of the wedges 36 on circumferential recess 18, and correspondingly the force exerted by the wedges against the seat 30. The handguard 24 is prevented from excessive axial misalignment or movement along the axis of the barrel due to the dimension of the upper surface of each wedge 36 in the longitudinal direction being substantially the same as the dimension of the circumferential recess 18 in the longitudinal direction so that the wedges 36 are closely received in the circumferential recess 18.

Figure 4:
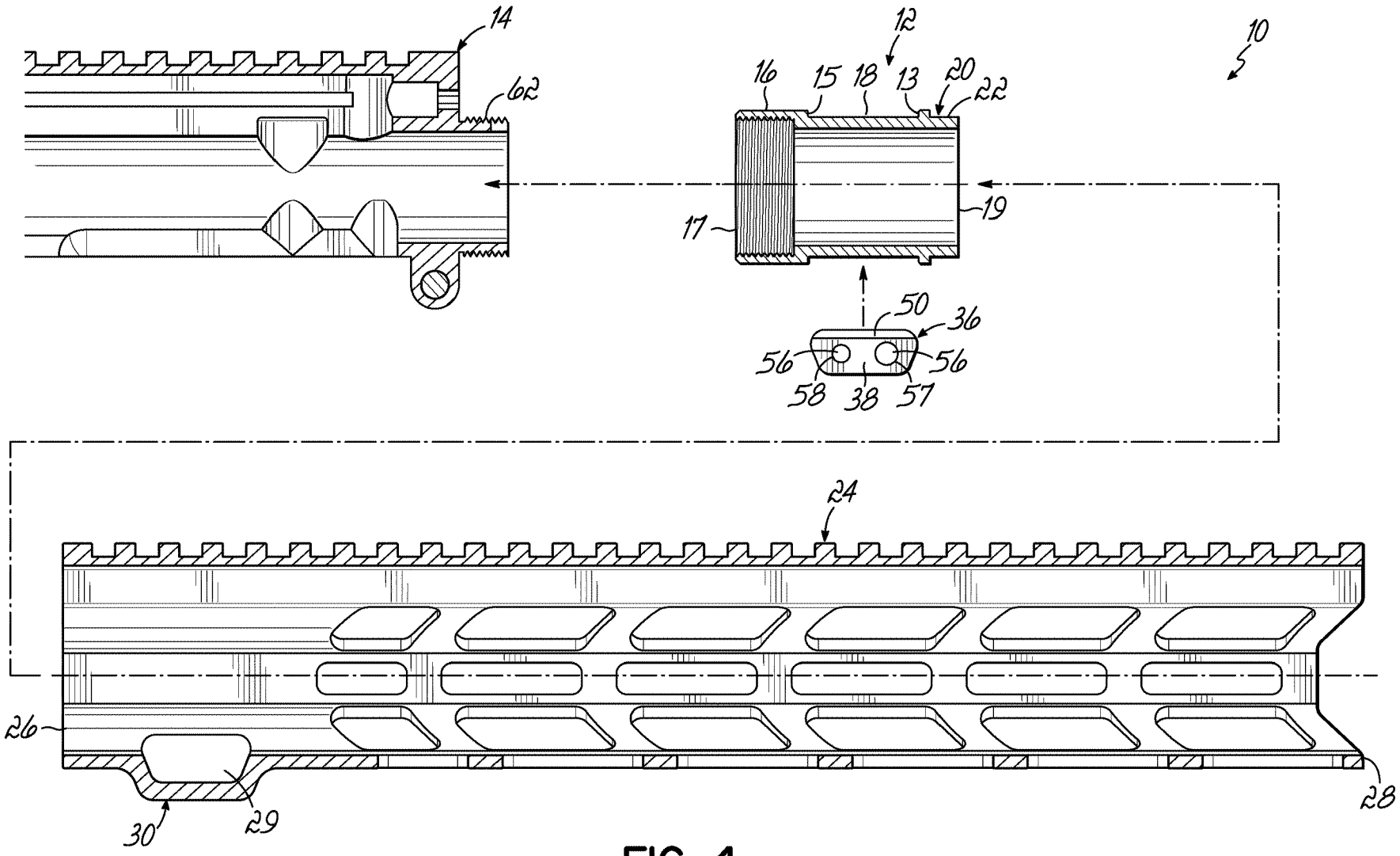
FIG. 4 is a disassembled axial cross-sectional view of the handguard attachment.

Referring now to FIG. 4, the handguard attachment 10 is assembled by threading the barrel nut 12 onto a male thread pattern 62 of an upper receiver 14 for an AR-pattern firearm. The handguard 24 is then slid over the barrel nut 12. When the seats 30 of the handguard 24 are aligned with the circumferential recess 18 of the barrel nut 12, the wedges 36 are inserted into the seats 30 thereby aligning the clearance bores 57 and threaded bores 58. As shown in FIG. 4, the handguard 24 may feature a rail or rails for installing auxiliary components such as sights, lasers, flashlights or the like. The embodiment depicted in FIG. 4 is shown as constructed to feature both M-LOK and Picatinny rails, however, other embodiments (not shown) may feature different rail configurations.

Figure 5:
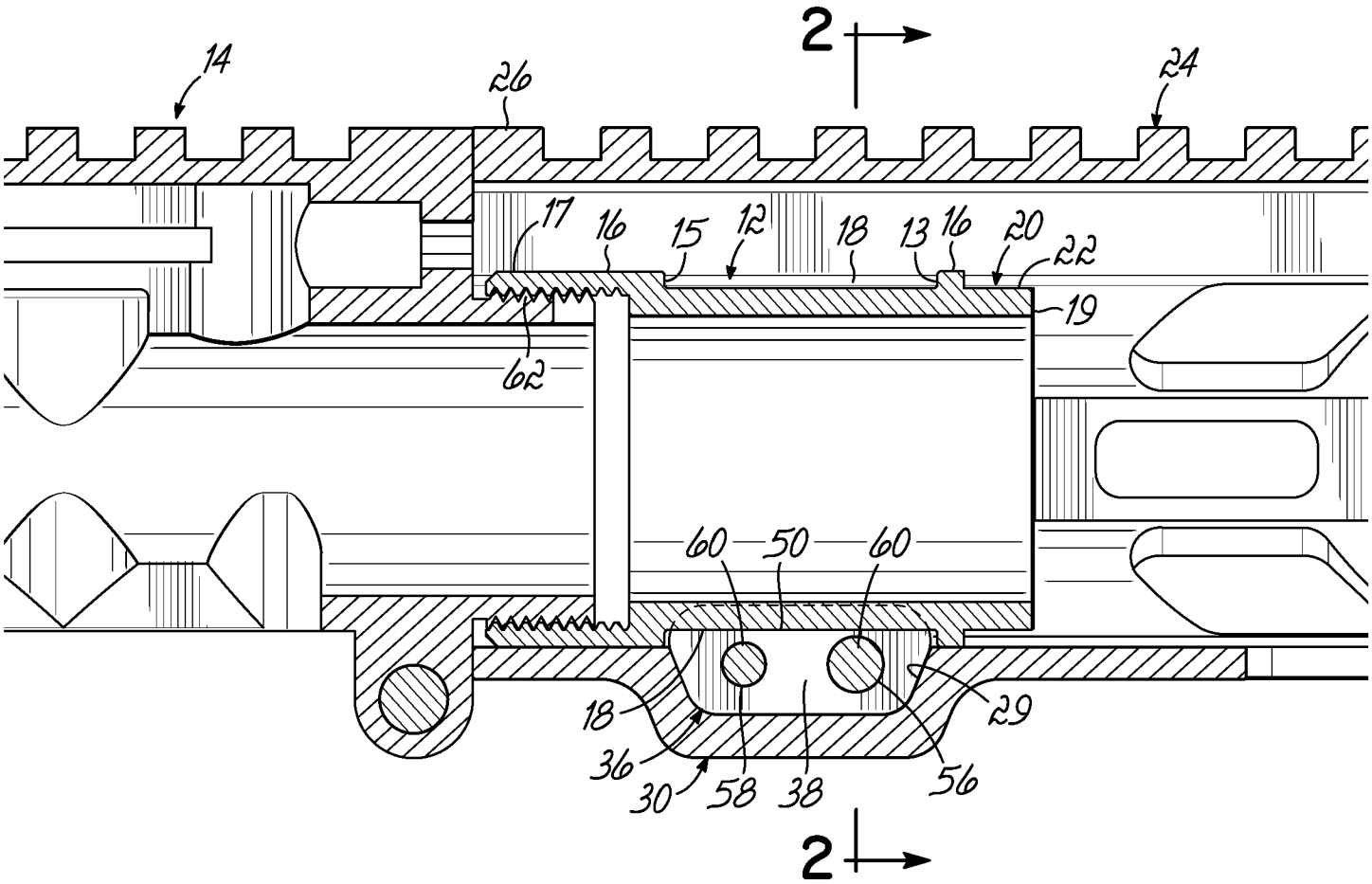
FIG. 5 is an assembled axial cross-sectional view, enlarged, of a portion of the handguard attachment assembled.

Referring now to FIG. 5, the handguard attachment 10 is properly aligned when the wedges 36 are capable of being inserted into the seat 30 and the wedges 36 fit within the spatial parameters of the circumferential recess 18. The wide wedges offer greater abutment against the handguard than a narrow securement screw.

Figure 6:
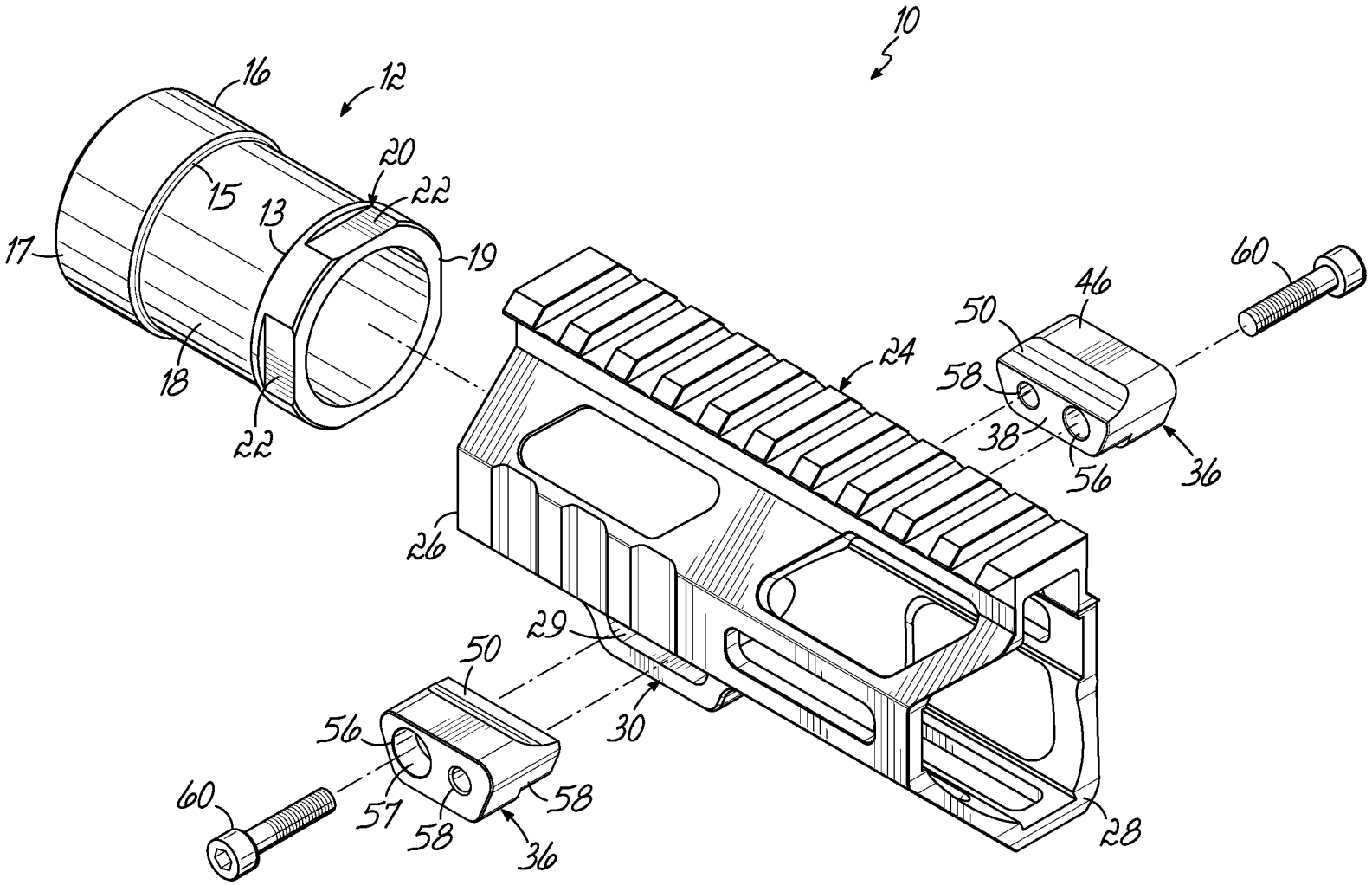
FIG. 6 is a disassembled isometric view, enlarged, of a portion of the handguard attachment.

Referring now to FIG. 6, and as previously alluded to, the wedges 36 may possess alternatingly opposed clearance bores 57 and threaded bores 58. Accordingly, the fasteners 60 are inserted into bores 56 from opposing sides of the handguard 24. This is the preferred embodiment as it equally distributes the tightening forces that urge the wedges 36 together to secure the handguard 24 in place. However, alternative embodiments (not shown) may feature bores 56 which are not alternatingly threaded. Still other embodiments (not shown) may feature more than two bores 56. This variance could depend on the size and/or desired durability of the handguard 24.

While one or more embodiments of the present invention have been described in detail, it should be apparent that modifications and variations thereto are possible, all of which fall within the true spirit and scope of the invention.

Therefore, the foregoing is intended only to be illustrative of the principles of the invention. Further, since numerous modifications and changes will readily occur to those skilled in the art, it is not intended to limit the invention to the exact construction and operation shown and described. The invention resides in each individual feature described herein, alone, and in any and all combinations and subcombinations of any and all of those features. Accordingly, all suitable modifications and equivalents may be included and considered to fall within the scope of the invention, defined by the following claim or claims.

What is claimed is:

1. A firearm handguard attachment device comprising:

a barrel nut having a forward end, a rearward end, and a circumferential recess between the forward end and the rearward end, the recess having an uninterrupted surface and defining a forward shoulder and a rearward shoulder, a handguard having a forward end and a rearward end and configured to be slid onto the barrel nut, the handguard having a transversely extending opening in a lower portion thereof, the opening having a seat at each opposite end, a pair of wedges, one wedge of the pair being installed in one of the seats and the other wedge of the pair being installed in the other seat, and at least one fastener for drawing the wedges toward one another, the wedges configured to engage the uninterrupted surface of the recess to prevent axial translation of the handguard relative to the barrel nut and to prevent axial rotation of the handguard relative to the barrel nut, and wherein each wedge has a laterally inwardly facing arcuate surface and a substantially flat upwardly facing surface having a length in a longitudinal direction, a radius of curvature of the arcuate surface matching a radius of curvature of the uninterrupted surface of the recess, the length of the upper surface corresponding to a length between the forward and rearward shoulders of the recess and engaging a corresponding surface inside the seat.

2. The firearm handguard attachment device as of claim 1, wherein the barrel nut includes knurling on the rearward end rearward of the recess and wrench flats on the forward end forward of the recess.

* * * * *